US008031895B2

(12) United States Patent
Schultz

(10) Patent No.: US 8,031,895 B2
(45) Date of Patent: Oct. 4, 2011

(54) DRIVER AND ENCLOSURE COMBINATION

(76) Inventor: Roland P. Schultz, Joshua Tree, CA (US)

( * ) Notice: Subject to any disclaimer, the term of this patent is extended or adjusted under 35 U.S.C. 154(b) by 965 days.

(21) Appl. No.: 11/950,813

(22) Filed: Dec. 5, 2007

(65) Prior Publication Data

US 2008/0130932 A1 Jun. 5, 2008

Related U.S. Application Data

(63) Continuation of application No. PCT/US2006/022064, filed on Jun. 6, 2006.

(60) Provisional application No. 60/688,871, filed on Jun. 9, 2005.

(51) Int. Cl.
*H04R 1/20* (2006.01)

(52) U.S. Cl. ..... 381/345; 381/349; 381/352

(58) Field of Classification Search ..... 381/345, 381/346, 348, 349, 352; 181/148, 151, 155, 181/159, 198, 199
See application file for complete search history.

(56) References Cited

U.S. PATENT DOCUMENTS 5,373,564 A * 12/1994 Spear et al. ..... 181/156
5,821,471 A * 10/1998 McCuller ..... 181/156
6,771,787 B1 * 8/2004 Hoefler et al. ..... 181/156
6,798,892 B2 9/2004 Parnell

* cited by examiner

*Primary Examiner* — Brian Ensey
(74) *Attorney, Agent, or Firm* — John J. Connors; Connors & Assoc.

(57) ABSTRACT

An enclosure includes a chamber holding a driver with an end at a first opening in a housing and a rear end nearby a first terminal end of a passageway having a second terminal end at a second opening in the housing. The driver projects sound waves into a listening area directly through the first opening and simultaneously projects sound waves along the passageway and out the second opening into the listening area. The passageway comprises expansion and compression zones of different cross-sectional areas.

25 Claims, 6 Drawing Sheets

ORIGINAL SIGNAL (DIRECT)

THROUGH CALIBRATED MIC SOME SPEAKER MAKERS USE PROCESSORS TO ACHIEVE THIS CLEAR SOUND REPRODUCTION (SAME SET-UP WITH CALIBRATED MIC)

DRIVER AND ENCLOSURE COMBINATION

RELATED PATENT APPLICATIONS & INCORPORATION BY REFERENCE

This application is a continuation of international application PCT/US2006/022064, international filing date Jun. 6, 2006, which claims the benefit under 35 USC 119(e) of U.S. provisional patent application Ser. No. 60/688,871, entitled "DRIVER AND ENCLOSURE COMBINATION," filed Jun. 9, 2005. These related applications are incorporated herein by reference and made a part of this application. If any conflict arises between the disclosure of the invention in this application and that in the related provisional application, the disclosure in this application shall govern. Moreover, the inventor incorporates herein by reference any and all U.S. patents, U.S. patent applications, and other documents, hard copy or electronic, cited or referred to in this application.

DEFINITIONS

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

"Rectangular" includes square.

BACKGROUND OF INVENTION

With high-end audio test equipment, an original audio signal can be compared to a secondary, corresponding audio output signal that has passed through various types of audio components. If the "timber" of both these audio signals is substantially identical, there is no perceived "coloration" of these two signals. In other words, their sound quality is essentially the same: poor quality original signal, poor quality secondary signal; high quality original signal, high quality secondary signal. For example, a sound recording is played on audio equipment that provides an electronic signal corresponding to the sound recording. This electronic signal operates a driver within an enclosure. The driver includes a conical member that undulates in response to the electronic signal to produce a sound wave. The sound wave propagates through the enclosure from an input end to an output end. An audio analysis of the original audio signal from the driver near the input end and the secondary audio signal at the output end will detect any "coloration." Avoiding or minimizing "coloration" between the original audio signal and the secondary audio signal may be advantageous in many situations.

SUMMARY OF INVENTION

This invention has one or more features as discussed subsequently herein. After reading the following section entitled "DETAILED DESCRIPTION OF SOME EMBODIMENTS OF THIS INVENTION," one will understand how the features of this invention provide its benefits, which include, but are not limited to: a driver enclosure that provides a secondary, corresponding audio signal having a timber substantially identical to its original, audio signal, in other words, without any substantial "coloration."

Without limiting the scope of this invention as expressed by the claims that follow, some, but not necessarily all, of its features are:

One feature of this invention is that it includes a novel and non-obvious driver enclosure and a combination of a conventional driver and the enclosure of this invention.

Two, the enclosure comprises a housing including a passageway, which may be sinuous and may have one or more sound absorbing members along it. Typically, the housing includes a front section having therein first and second openings and a chamber including the first opening and a rear section opposite the front section. The housing may be box-type and it may be constructed of a material having a substantially uniform density substantially from 30 to 50 pounds per cubic foot. Suitable material may be medium density fiberboard or plywood that is essentially free of air pockets or a molded plastic. The chamber is sealed so that substantially all air within the chamber exits the chamber through the first and second openings.

Three, the passageway includes at least one expansion zone with a predetermined maximum cross-sectional area and at least one compression zone. The passageway may have a predetermined length and a first open end terminating in the rear section of the chamber and a second open end terminating at or nearby the second opening. The passageway may have a cross-sectional area that increases and decreases along the length of the passageway to provide prior to the second opening the maximum cross-sectional area, and its length may have a substantially uniform width along entire length of the passageway. The second opening may be substantially less than the maximum cross-sectional area.

Four, the passageway may include a plurality of expansion and compression zones formed by a plurality of folds at selected junctions along the length of the passageway to change the direction of the propagation of sound waves along the passageway. The expansion and compression zones commence with a initial fold that may have a minimum cross-sectional area. There may be intermediate folds increasing and decreasing in cross-sectional area sequentially to a final fold. This final fold may have a maximum cross-sectional area, ending in a terminal or final compression zone having a terminal end at or nearby the second opening. The final compression zone may have a cross-sectional area that is substantially from 50% to 85% of said maximum cross-sectional area, for example, approximately 75% of the maximum cross-sectional area. The passageway may be substantially rectangular in cross-sectional shape with a height that fluctuates along the passageway's length to create the expansion and compression zones. For example, the width of the passageway may be constant within the range substantially from 3 to 36 inches, and its height may vary substantially from 3 to 36 inches.

Five, a conventional driver is mounted in the enclosure of this invention. It projects sound waves into a listening area directly through the first opening and simultaneously projects sound waves along the passageway and out the second opening into the listening area. The driver may have a front face end nearby the first opening and a rear end nearby the first terminal end of the passageway. At least 90 percent of the sound waves may exit the second opening into the listening area. The driver may be substantially in the shape of a truncated cone having an edge at the front face end adjacent the first opening. The edge of the cone may have a substantially circular perimeter. The first opening may be substantially circular and may have a diameter substantially the same as a diameter of the circular perimeter. The edge and first opening may be adjacent.

These features are not listed in any rank order nor is this list intended to be exhaustive.

DESCRIPTION OF THE DRAWING

Some embodiments of this invention, illustrating all its features, will now be discussed in detail. These embodiments depict the novel and non-obvious (a) driver enclosure and (b) driver and enclosure combination of this invention as shown in the accompanying drawing, which is for illustrative purposes only. This drawing includes the following figures (Figs.), with like numerals indicating like parts:

FIG. 8A shows an audio wave at the entry of the passageway of the driver enclosure of this invention and inputted into the oscilloscope for display;

FIG. 8B shows an audio wave detected by a microphone in front of the exit of the passageway of the driver enclosure of this invention and inputted into the oscilloscope for display; and FIG. 8C shows an audio wave detected by a microphone in front of a conventional driver enclosure and inputted into an oscilloscope for display.

DETAILED DESCRIPTION OF SOME EMBODIMENTS OF THIS INVENTION

Figure 1:
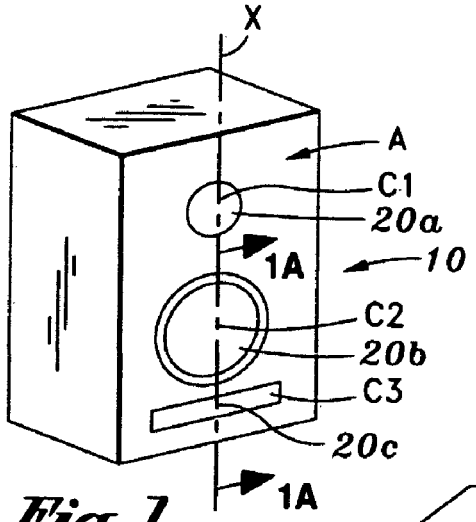
FIG. 1 is a perspective view of one embodiment of the driver and enclosure combination of this invention.
Figure 2:
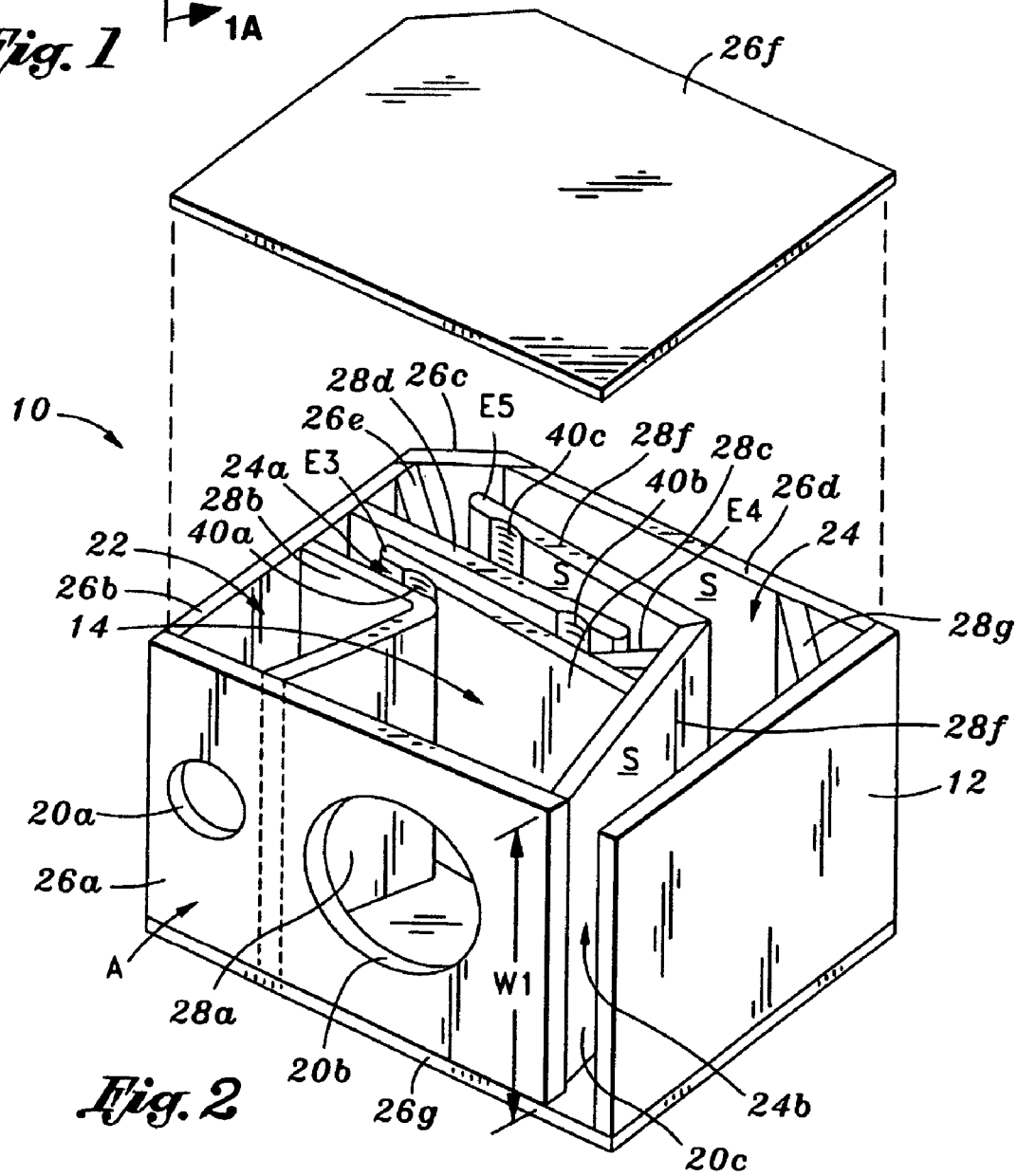
FIG. 2 is an exploded, perspective view of the driver and enclosure combination of FIG. 1 showing a passageway within the interior of a housing.
Figure 3:
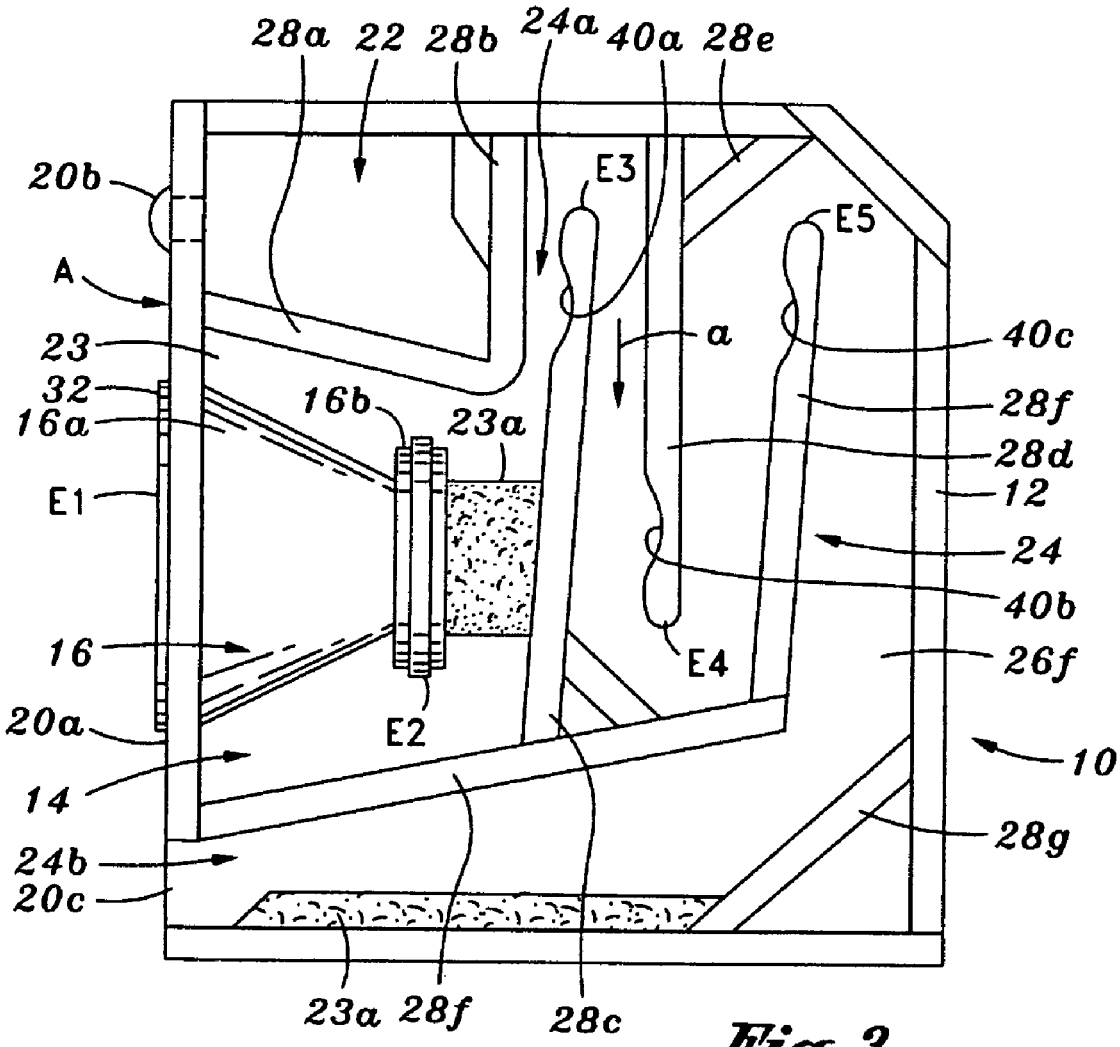
FIG. 3 is a side view of the housing with a side removed.

FIGS. 1 through 3

As shown in FIGS. 1 through 3, one embodiment of this invention is the driver and enclosure combination 10, which includes a housing 12 having a chamber 14 that holds a conventional driver 16, in this embodiment, a low range woofer driver. The driver 16 comprises a truncated conical member 16*a* and a magnetic pick up assembly 16*b* (FIG. 3) that responds to an electronic signal to move the conical member 16*a*. The housing 12 has a side or front section A with a pair of substantially circular openings 20*a* and 20*b* and one substantially rectangular opening 20*c*. As depicted in FIG. 1, the centers C1, C2, and C3 of these opening 20*a*, 20*b*, and 20*c* all lie along a reference center line X. The opening 20*a* provides access to a chamber 22 holding a tweeter driver (not shown). The opening 20*b* provides access to the chamber 14 holding the driver 16. The tweeter driver and the driver 16 are respectively have their forward edges lodged in the 20*a* and 20*b* and are sealed. The chambers 14 and 22 substantially isolate the sounds from the tweeter driver and driver 16 from each other until they are mixed in a listening area in front of the driver and enclosure combination 10.

A passageway 24 extends between the chamber 14 and the rectangular opening 20*c*. This passageway 24 has a first terminal end 24*a* in communication with the chamber 14 and a second terminal end 24*b* in communication with the rectangular opening 20*c*, The truncated conical member 16*a* has a front face end E1 nearby the opening 20*b* and the rear of the magnetic pick up assembly 16*b* is nearby the first terminal end 24*a* of the passageway 24. There may be one or more sound absorbing members in the chambers 14 and 22 and along the passageway 24. For example, open cell, foam blocks or sheets 23, typically rigid, may be used and positioned as shown in FIGS. 3 and 5, namely, along the passageway near the rectangular opening 20*c*. Flexible, open cell, foam material 23*a* (FIGS. 3 and 5) may be placed behind the diver 16.

As best shown in FIGS. 2 and 3, the housing 12 is essentially a box-type structure formed from planar panels 26*a*, 26*b*, 26*c*, 26*d*, 26*e*, 26*f*, and 26*g* having substantially flat surfaces. The chambers 14 and 22 and the passageway 24 are also formed from planar panels 28*a*, 28*b*, 28*c*, 28*d*, 28*e*, 28*f*, and 28*g* having substantially flat surfaces. These panels 26*a*-26*g* and 28*a*-28*g* may be, for example, fiber board (for example, medium density fiber board) or plywood (ATX) that is essentially free of air pockets or a molded plastic, which, for example, may all comprise a material having a substantially uniform density from about 30 to about 50 pounds per cubic foot. The panels 26*a*-26*g* and 28*a*-28*g* are screwed and glued or otherwise connected together as depicted to form the housing 12 and the passageway 24. The flat panels form smooth wall surfaces S (FIG. 2) of the passageway 24, and the heads of any screws are countersunk.

Figure 4:
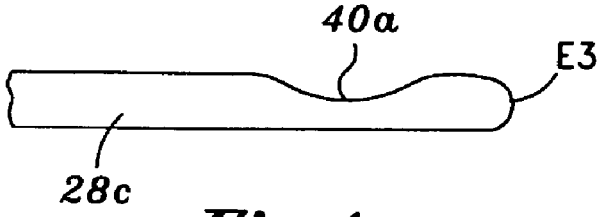
FIG. 4 is an enlarged, fragmentary end view of a terminal edge of a wall of the passageway within the housing.

As shown in FIG. 4, an optional feature of this invention is that some of the panels forming the passageway 24 have sculptured free ends, for example, the panels 28*c*, 28*d*, and 28*f*. These sculptured free ends are at a junction where the passageway 24 makes a sharp turn. Shallow, concave indentations 40*a*, 40*b*, and 40*c* are positioned respectively nearby the free ends E3, E4, and E5 of the panels 28*c*, 28*d*, and 28*f*, and these free ends are rounded. The indentations 40*a*, 40*b*, and 40*c* are substantially parallel to the free ends E3, E4, and E5. These rounded free ends E3, E4, and E5, with their respective, adjacent indentations 40*a*, 40*b*, and 40*c*, allow the air to flow in a less restricted manner through the passageway 24.

Figure 1A:
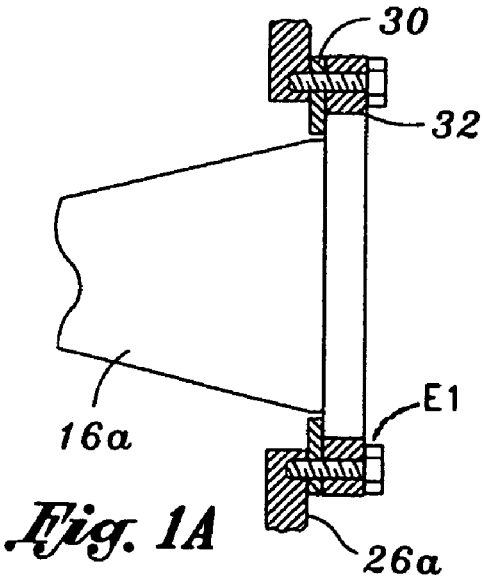
FIG. 1A is a cross-sectional view taken along line 1A-1A of FIG. 1.

The truncated conical member 16*a* has a front circular perimeter end E1 having a diameter substantially the same as the diameter of the opening 20*b*. The circular end E1 is adjacent to and fits snug within the opening 20*b*. As illustrated in FIG. 1A, the front end E1 has a lip 30 that overlaps the perimeter of the opening 20*b* and a ring 32 overlies this lip and is screwed or otherwise attached securely to the exterior of panel 26*a* to provide a seal around the front end E1 of the conical member 16*a*. The rear end E2 (FIG. 3) of the conical member 16*a* is attached to the magnetic pick up assembly 16*b*. In response to electronic signals from an amplifier (not shown), the magnetic pick up assembly 16*b* moves the conical member 16*a* towards and away from section A to produce sound waves. The conical member 16*a* projects these sound waves into the listening area directly through the opening 20*b* and simultaneously projects sound waves along the passageway 24 and out the rectangular opening 20*c* into the listening area. Because the chambers 14 and 22 are sealed, the air exits and enters this chamber substantially rectangular opening 20*c*. In the driver and enclosure combination 10, at least about 90 percent of the sound waves exit the opening 20*c* into the listening area.

Figure 5A:
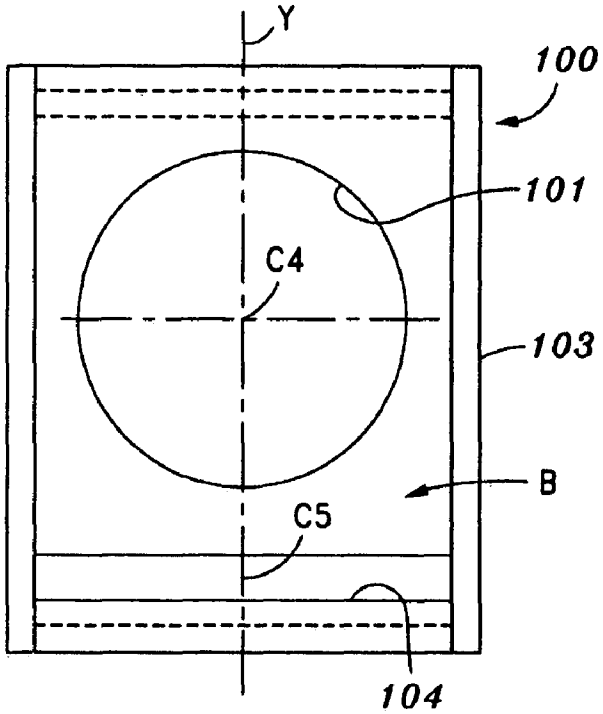
FIG. 5A is the front view taken along line 5A-5A of FIG. 5.
Figure 5:
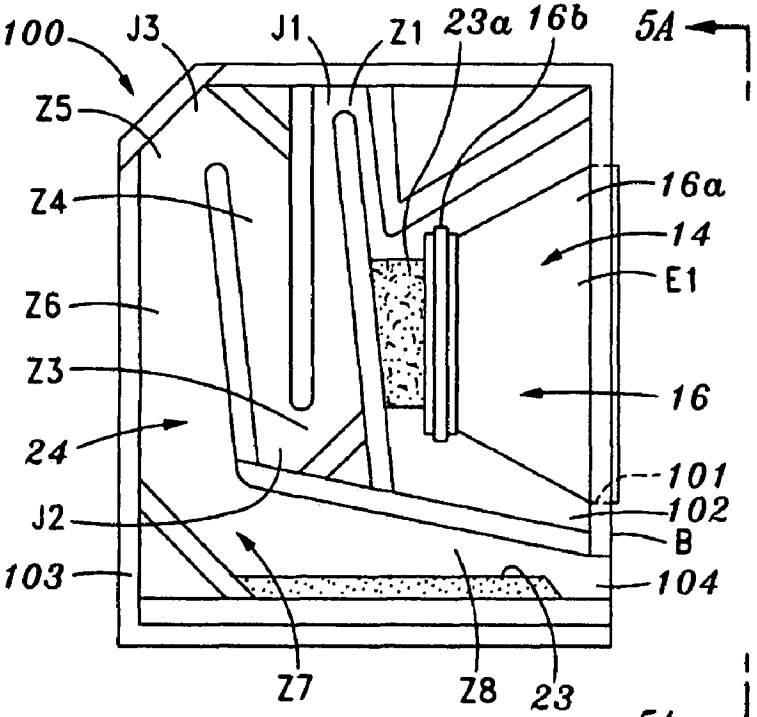
FIG. 5 is a side view of another embodiment of the driver and enclosure combination of this invention with a side of its housing removed

FIGS. 5 and 5A

In FIGS. 5 and 5A, an alternate embodiment of this invention, the driver and enclosure combination 100, is depicted. This driver and enclosure combination 100 is similar to the driver and enclosure combination 10, except there is no tweeter chamber 22. The driver 16 is within a chamber 102 in a housing 103 made of substantially flat, planar panels as discussed above. A front section B of the housing or enclosure 103 has a circular opening 101 and a rectangular opening 104 with their respective centers C4 and C5 aligned along a center reference line Y. Like the embodiment depicted in FIGS. 1-3, the driver and enclosure combination 100 includes the passageway 24 that extends from the chamber 102 to the rectangular opening 104 in the section B. The front end E1 of the truncated conical member 16*a* is seated in the opening 101 and attached to section B as discussed above and the rear of the magnetic pick up assembly 16*b* is near the entry end 24*a* of the passageway 24.

Figure 6A:
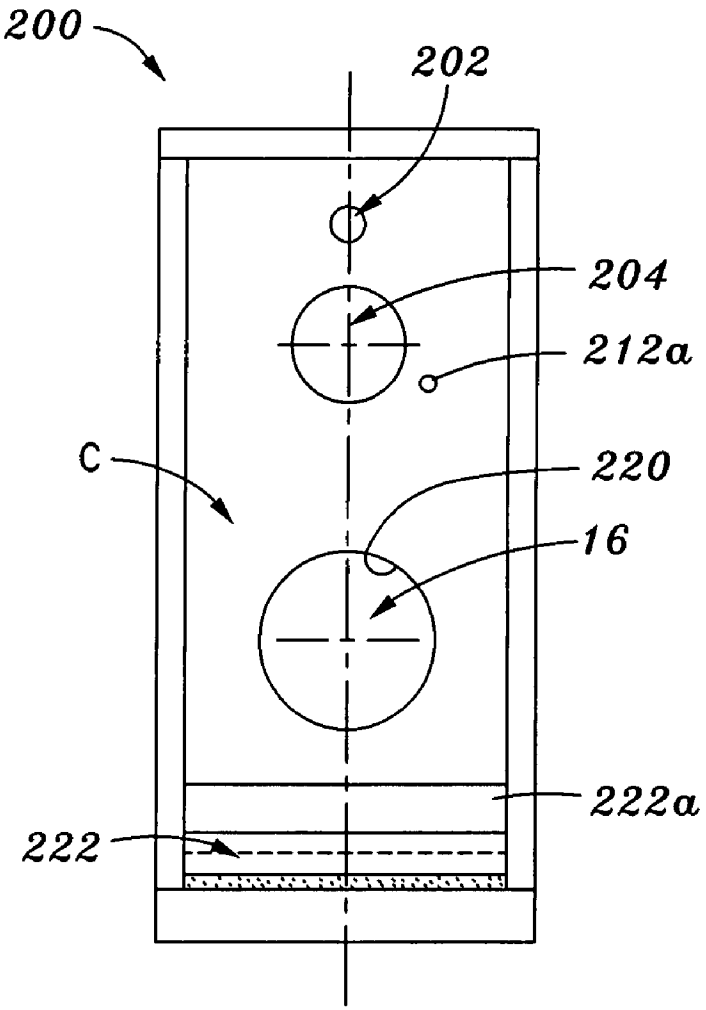
FIG. 6A is the front view taken along line 6A-6A of FIG. 6.
Figure 6:
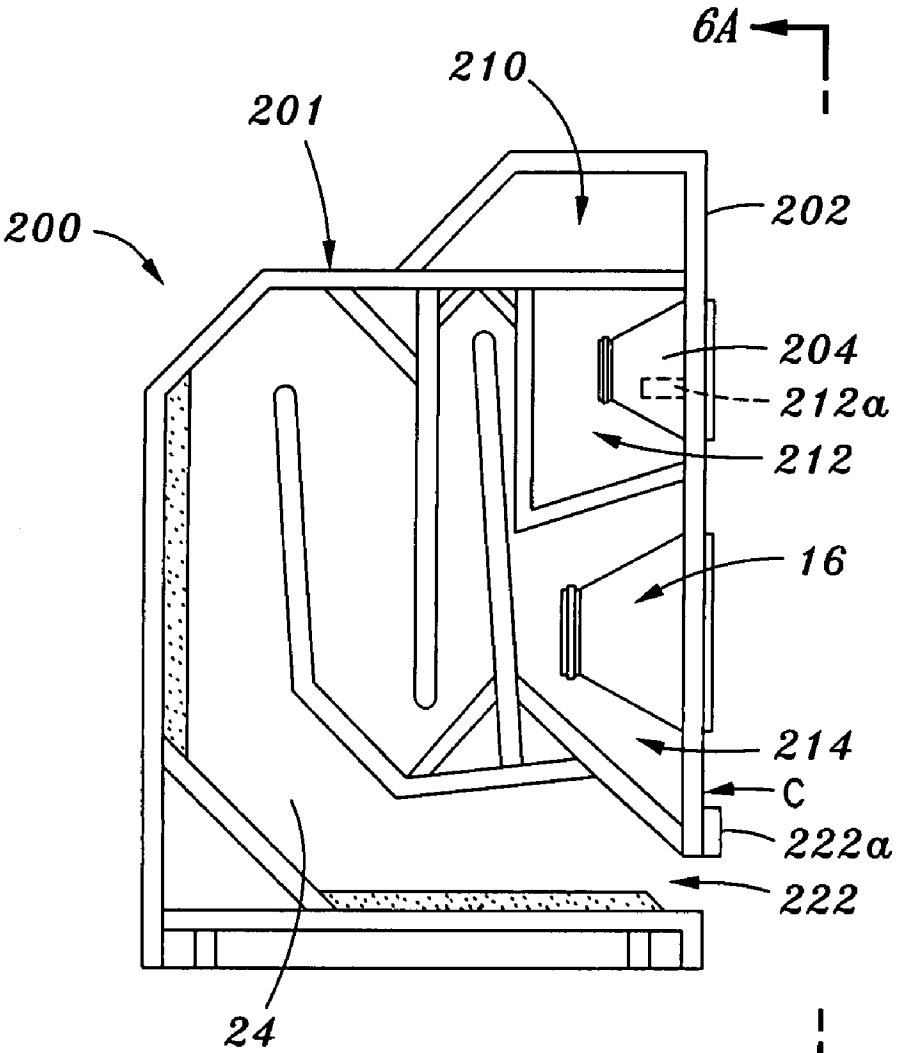
FIG. 6 is a side view of still another embodiment of the driver and enclosure combination of this invention with a side of its housing removed

FIGS. 6 and 6A

The embodiment 200 shown in FIGS. 6 and 6A includes a housing 201(FIG. 6) construed as discussed above except it is designed to hold three drivers: a tweeter driver 202, a mid-range driver 204, and the woofer driver 16. The mid-range driver 204 is between the tweeter driver 202 and the woofer driver 16. All three drivers 202, 204 and 16 are in separate chambers 210, 212, and 214, respectively, substantially isolating the sound from these drivers from each other until mixed in the listening area. The chamber 212 may include a breather tube 212*a*. The passageway 24 extends from a circular opening 220 in a front section C to a rectangular opening 222 in the front section C. A sliding door 222*a* may be positioned at the rectangular opening 222 to vary the area of this opening to change the quality of the sound, for example, when the sliding door is moved to the position shown in dotted lines in FIG. 6A.

Figure 7:
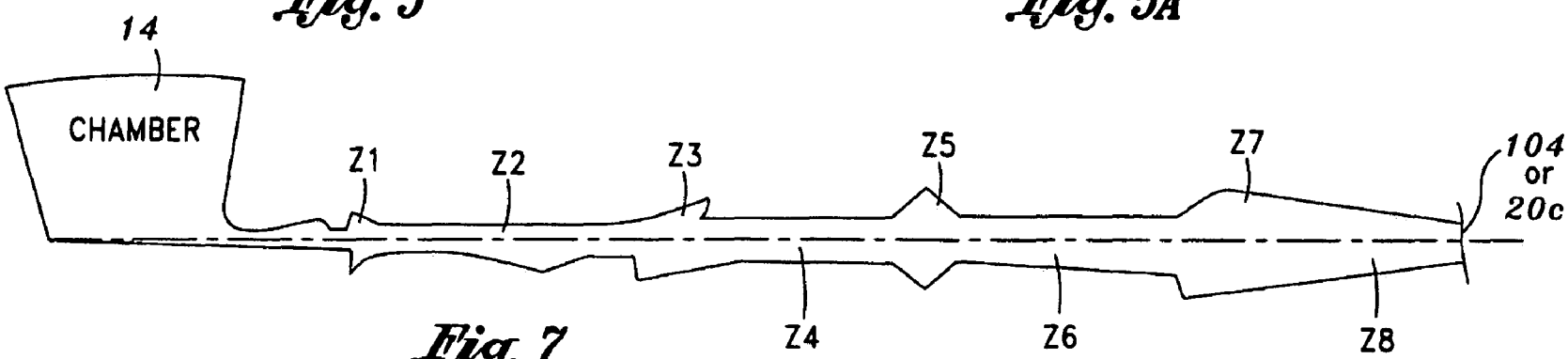
FIG. 7 is a schematic diagram of the enclosure's passageway unfolded and illustrating compression and expansion zones along the passageway.
Figure 8A:
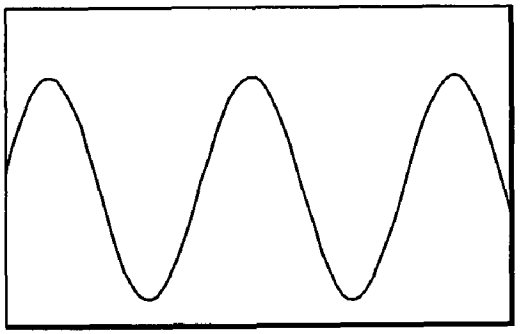
FIGS. 8A through 8C are reproductions of a display screen of an oscilloscope, where
Figure 8B:
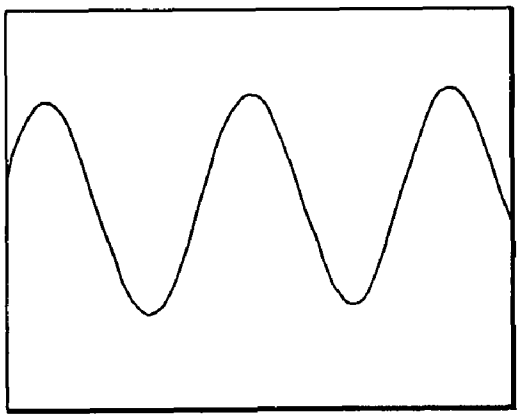
Figure 8C:
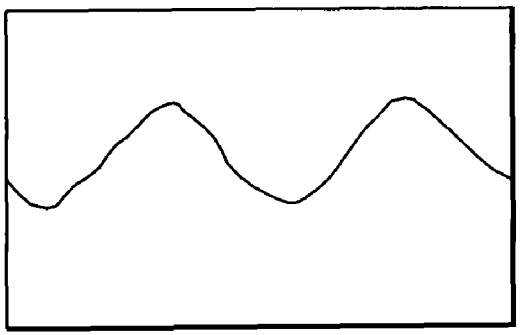
Figure 9:
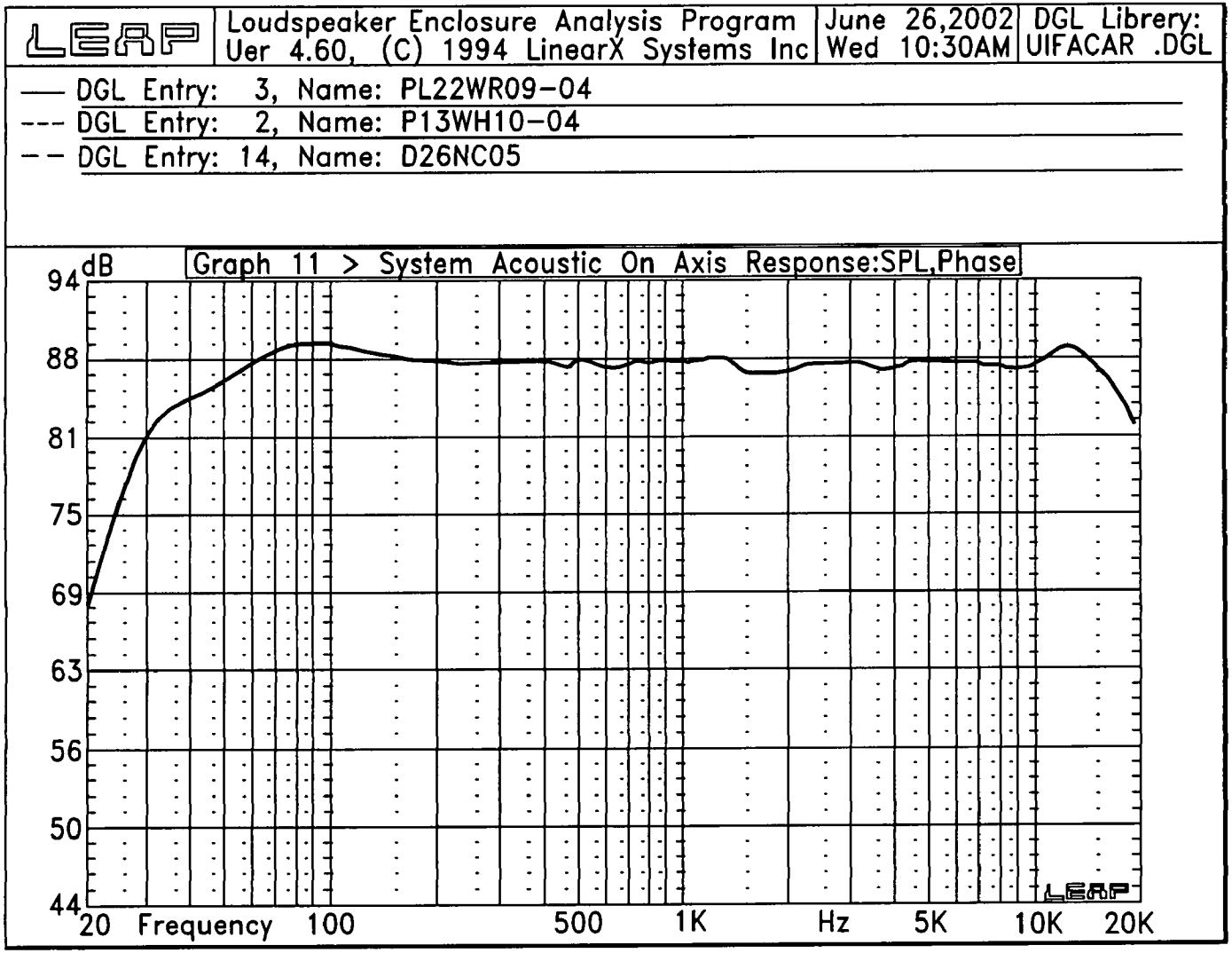
FIG. 9 is a graph provided by a test using a loudspeaker enclosure analysis program.

FIGS. 7 through 9

In the embodiments discussed above, the passageway 24 is sinuous and includes expansion and compression zones Z1 through Z8. (FIGS. 5 and 7) formed by a plurality of folds at different junctions J1, J2, J3, and J4 (FIG. 5) along the length of the passageway to change the direction of propagation of the sound waves. The passageway 24 has a substantially uniform and constant width w1 (FIG. 2) along its entire length. The width w1 will vary depending on the size of the enclosure. In the embodiments depicted, the passageway 24 is substantially rectangular in cross-sectional shape with a height that fluctuates along the passageway's length to create the expansion and compression zones Z1 through Z8. For example, the width w1 of the passageway 24 is constant and in the range from 3 to 36 inches, and the height of the passageway varies from 3 to 36 inches. In accordance with this invention, the passageway 24 comprises at least one expansion zone, for example, zone Z7, with a predetermined maximum cross-sectional area and at least one compression zone with a predetermined cross-sectional area substantially less than the maximum cross-sectional area. The passageway 24 terminates in a compression zone Z8 at or nearby the rectangular opening 20*c* that has a cross-sectional area that is from 50% to 85% of the maximum cross-sectional area, For example, the compression zone Z8 may have a cross-sectional area that is approximately 75% of the maximum cross-sectional area of the zone Z7 at the rectangular opening 20*c* or 104, as the case may be.

FIG. 7 is a schematic rendering of the passageway 24 unfolded along a horizontal line. It illustrates how the cross-sectional area of the passageway 24 increases and decreases along the length of the passageway 24 from the chamber 14 to the opening 20*c* or 104, as the case may be. In accordance with this invention, the sound waves move through these compression and expansion zones Z1 through Z8 as they are being emitted from the driver 16. Referring to FIGS. 5 and 7, the sound waves as they propagate along the passageway 24 first move into the expansion zone Z1, then into the compression zone Z2, which expands into the expansion zone Z3, and next into the compression zone Z4, which expands into the expansion zone Z5, and then into the compression zone Z6, which expands into the maximum expansion zone Z7, and finally into the final compression zone Z8 and out the rectangular opening.

FIGS. 8A, 8B, and 8C illustrate that the enclosure of this invention does not "color" an audio signal. FIG. 8A shows a 700 Hz sine waveform electronic audio signal that has been passed through an audio amplifier and displayed on the screen of an oscilloscope. This signal represents a pure test tone that is used to compare the enclosure of this invention with a conventional driver enclosure. This 700 Hz sine waveform is considered a pure signal that is not subjected to conditions that cause "coloration" because it is not being projected through a driver but only the amplification stage. The 700 Hz test sine waveform was passed through an audio amplifier and into the end 24*a* of the passageway 24, propagating along the passageway 24. A calibrated microphone was placed in front of the driver and enclosure combination of this invention about 2 to 3 feet from its front section. The microphone detected the sound waveform emanating from the driver and enclosure combination of this invention, which was then inputted into an oscilloscope. As illustrated in FIG. 8B, the visual image of this sound emanating from the terminal end 24*b* is essentially identical to that of the visual image of the 700 Hz test sine waveform shown in FIG. 8A. Since the visual images of the sound emanating from the enclosure of this invention and that of the 700 Hz test sine waveform are substantially the same, there is no apparent "coloration." FIG. 8C depicts the 700 hz test sine waveform passed through an audio amplifier into a conventional bass reflex speaker and then inputted into an oscilloscope via a calibrated microphone placed in front of the bass reflex speaker. The output signal from the bass reflex speaker shows "coloration" and distortion, because it is the very dissimilar to the 700 Hz test sine waveform shown in FIG. 8A.

The driver and enclosure combination of this invention was a tested using a spectrum analyzer. The test program works in this manner: a pink noise generator emits all the frequencies in the human audible range of 20 Hz to 20,000 Hz at a specific sound pressure level. Using a calibrated microphone placed in front of a loudspeaker enclosure the test measures the sound pressure level of all frequencies being emitted from a given loudspeaker enclosure. A graph is then generated to represent visually the measurement of frequencies and their variation from the set sound pressure level. The enclosure of this invention was tested using this program and the graph depicted in FIG. 9 shows the frequency curve that this invention reproduces from the inputted pink noise generator. This test shows that there is little variation. Any overly accentuated or de-accentuated frequencies would indicate "coloration" and harmonic distortion. The test shows that no particular frequency is overly accentuated or de-accentuated.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiments disclosed. On the contrary, the intention is to cover all modifications and alternate constructions coming within the spirit and scope of the invention as generally expressed by the following claims, which particularly point out and distinctly claim the subject matter of the invention:

The invention claimed is:

1. A driver and enclosure combination comprising a housing having a front section with first and second openings therein, a chamber including the first opening, and a passageway having a first terminal end in communication with the chamber and a second terminal end in communication with the second opening, said chamber including a driver having a front face end nearby said first opening and a rear end nearby said first terminal end of the passageway, said chamber being sealed so that air within the chamber exits said chamber substantially through the first and second openings, said driver projecting sound waves into a listening area directly through the first opening and simultaneously projecting sound waves along said passageway and out the second opening into the listening area, said passageway comprising at least one expansion zone with a predetermined maximum cross-sectional area and at least one compression zone, and said passageway terminating in a final compression zone at or nearby the second opening that has a cross-sectional area that is from 50% to 85% of said maximum cross-sectional area.

2. The combination of claim 1 where the housing is a box-type structure comprising a material having a substantially uniform density from 30 to 50 pounds per cubic foot.

3. The combination of claim 2 where the material is medium density fiberboard or plywood that is essentially free of air pockets or a molded plastic.

4. The combination of claim 1 where at least 90 percent of the sound waves exit the second opening into the listening area.

5. The combination of claim 1 where the driver is substantially in the shape of a truncated cone having an edge at the front face end adjacent the first opening, said edge having a substantially circular perimeter, said first opening being substantially circular and having a diameter substantially the same as a diameter of the circular perimeter, said edge and first opening being adjacent.

6. The combination of claim 1 where the passageway has a predetermined length with a substantially uniform width along said entire length.

7. The combination of claim 6 where the passageway is substantially rectangular in cross-sectional shape with a height that fluctuates along the passageway's length to create the expansion and compression zones.

8. The combination of claim 6 where the width of the passageway is constant and within the range from 3 to 36 inches, and height of the passageway varies from 3 to 36 inches.

9. The combination of claim 1 where said expansion and compression zones are formed by a plurality of folds at predetermined junctions along the length of the passageway to change the direction of propagation of the sound waves.

10. The combination of claim 1 where the final compression zone has a cross-sectional area that is approximately 75% of said maximum cross-sectional area.

11. The combination of claim 1 including one or more sound absorbing members along the passageway.

12. A driver and enclosure combination comprising a housing having a front section with first and second openings therein, a sealed chamber including the first opening and a driver adjacent said first opening, and a sinuous passageway having a first terminal end in communication with the chamber and a second terminal end in communication with the second opening, said passageway comprising a plurality of expansion and compression zones with at least one expansion zone having a predetermined maximum cross-sectional area, and said passageway terminating in a final compression zone immediately following the one expansion zone having said predetermined maximum cross-sectional area that terminates at or nearby the second opening with said second opening having a cross-sectional area that is from 50% to 85% of said maximum cross-sectional area.

13. The combination of claim 12 where the housing is a box-type structure comprising a material having a substantially uniform density from 30 to 50 pounds per cubic foot.

14. The combination of claim 13 where the material is medium density fiberboard or plywood that is essentially free of air pockets or a molded plastic.

15. The combination of claim 12 where the passageway has a predetermined length with a substantially uniform width along said entire length.

16. The combination of claim 15 where the passageway is substantially rectangular in cross-sectional shape with a height that fluctuates along the passageway's length to create the expansion and compression zones.

17. The combination of claim 13 where the final compression zone has a cross-sectional area that is approximately 75% of said maximum cross-sectional area.

18. A driver and enclosure combination comprising a housing including a front section having therein a circular openings and a rectangular opening, a chamber including the circular opening and a rear section opposite the front section, and a passageway having a first open end terminating in the rear section of the chamber and a second open end at or nearby the rectangular opening, and a driver within the chamber having a front face end nearby said first opening and a rear end nearby said first open end of the passageway, said passageway having a predetermined length and a substantially rectangular cross-sectional shape with a substantially uniform width along said entire length and a height that fluctuates along the passageway's length to create at least one expansion zone having a maximum cross-sectional area and a terminal compression zone immediately following the one expansion zone, said terminal compression zone terminating at or nearby the rectangular opening, said rectangular opening having a cross-sectional area that is substantially less than said maximum cross-sectional area.

19. The combination of claim 18 where the expansion and compression zones are formed by a plurality of folds at predetermined junctions along the length of the passageway, said junctions alternately increasing and decreasing in cross-sectional area.

20. The combination of claim 18 the cross-sectional area of the rectangular opening is from 50% to 85% of said maximum cross-sectional area.

21. The combination of claim 18 where the cross-sectional area of the rectangular opening is approximately 75% of said maximum cross-sectional area.

22. A driver enclosure comprising a box-type housing, said housing including a front section having therein first and second openings, a chamber including the first opening and a rear section opposite the front section, and a sinuous passageway having a predetermined length and a first open end terminating in the rear section of the chamber and a second open end terminating at or nearby the second opening, said passageway having a cross-sectional area that increases and decreases along the length of the passageway to provide prior to the second opening a maximum cross-sectional area with said second opening being substantially less than said maximum cross-sectional area.

23. The driver enclosure of claim 22 where the sinuous passageway includes a plurality of expansion and compression zones formed by a plurality of folds at selected junctions along the length of the passageway to change the direction of the propagation of sound waves along the passageway, said expansion and compression zones commencing with a initial fold having a minimum cross-sectional area and intermediate folds increasing and decreasing in cross-sectional area sequentially to a final fold having a maximum cross-sectional area and ending in a terminal compression zone having a terminal end at or nearby the second opening.

24. The driver enclosure of claim 22 where the box-type housing comprises a material having a substantially uniform density from 30 to 50 pounds per cubic foot.

25. The driver enclosure of claim 24 where the material is medium density fiberboard or plywood that is essentially free of air pockets or a molded plastic.

* * * * *